United States Patent [19]

Fisher

[11] Patent Number: 4,462,192

[45] Date of Patent: Jul. 31, 1984

[54] SEAL ASSEMBLY

[75] Inventor: Michael D. Fisher, Mooreland, Ind.

[73] Assignee: American Standard, Inc., New York, N.Y.

[21] Appl. No.: 383,408

[22] Filed: Jun. 1, 1982

[51] Int. Cl.[3] ..... E04H 1/00

[52] U.S. Cl. ..... 52/240; 52/243.1

[58] Field of Search ..... 52/240, 243.1

[56] References Cited

U.S. PATENT DOCUMENTS

| | | | |
|---|---|---|---|
| 2,670,505 | 3/1954 | Gall . | |
| 3,023,804 | 3/1962 | Howell, Sr. . | |
| 3,072,975 | 1/1963 | Burmeister . | |
| 3,073,381 | 1/1963 | Burmeister . | |
| 3,086,261 | 4/1963 | Lapof . | |
| 3,126,048 | 3/1964 | Hollands . | |
| 3,126,050 | 3/1964 | Lapof . | |
| 3,126,051 | 3/1964 | Sussin . | |
| 3,267,612 | 8/1966 | Horvat et al. . | |
| 3,292,321 | 12/1966 | Vander Schans . | |
| 3,295,588 | 1/1967 | Gilson . | |
| 3,381,738 | 5/1968 | Good et al. . | |
| 3,400,504 | 9/1968 | Neisewander . | |
| 3,755,968 | 9/1973 | Williams . | |
| 3,862,773 | 1/1975 | Bisbing | 292/70 |
| 3,862,774 | 1/1975 | Johnson | 292/228 |
| 4,014,137 | 3/1977 | Williams . | |

*Primary Examiner*—Carl D. Friedman

*Attorney, Agent, or Firm*—James J. Salerno, Jr.; John P. Sinnott; Robert G. Crooks

[57] ABSTRACT

A seal assembly arranged and constructed for an operable or portable wall panel to provide top, bottom or side seals therefor is disclosed. A channel shaped member is mounted in the panel in fixed position, with the open end of the channel extending outwardly to an edge thereof. A seal actuator means is operatively coupled to a spring loaded, shiftable seal assembly which is mounted in the channel and is held in a latched, retracted position. The spring-loaded seal assembly is shifted inwardly of the channel to release a latch means so that the springs are released to permit the seal assembly to shift outwardly of the channel to its extended, self-leveling sealed position.

8 Claims, 6 Drawing Figures

SEAL ASSEMBLY

BACKGROUND OF THE INVENTION

The invention relates to an operable wall panel of the type that is used to subdivide larger rooms into smaller rooms such as are found in hotels, hospitals, schools, offices or the like, and more particularly to a spring-loaded seal assembly which is shiftable from a retracted, inoperative position, to an extended, operative position to provide a top, bottom or side seal therefor.

Various types of seal assemblies for operable wall panels are known, for example crank operated top and bottom retractable seals are disclosed in U.S. Pat. No. 3,072,975, U.S. Pat. No. 3,073,381, U.S. Pat. No. 3,400,504 and U.S. Pat. No. 3,295,588. A floating seal assembly is shown in U.S. Pat. No. 3,755,968 and U.S. Pat. No. 4,014,137 shows cord or crank operated mechanism for raising and lowering the seal assembly of the wall panel.

SUMMARY OF THE INVENTION

It is an object of the invention to provide a seal assembly which is housed within the operative wall panel and is spring loaded in its retracted or inoperative position.

Another object of the invention is to provide an operative seal assembly which is releaseably latched in its retracted inoperative position and which can be shifted inwardly by seal actuator means to release a latch means so that the seal assembly is automatically urged outwardly to its self-leveling, sealed position.

Another object of the invention is to provide a shiftable seal assembly which is housed within a recess of a channel member of a wall panel and which includes a dual diameter pulley operatively coupled to a seal actuator means and a shiftable seal assembly. A latch means is mounted in the wall panel so that when the seal actuator is operated it rotates the pulley to shift the seal assembly inwardly to unlatch the latch means whereby the spring loaded seal assembly is automatically urged outwardly of the channel recess to its extended, self-leveling, sealed position.

Another object of the invention is to provide a spring-loaded seal assembly which can be operated by a cable coupled to a dual diameter pulley, the cable having a handle means positioned in the wall panel remote from the pulley.

Another object of the invention is to provide an improved seal assembly which is relatively inexpensive to manufacture, which requires a minimum of parts to assemble, is simple to install and is reliable in operation.

The invention generally contemplates providing a spring-loaded shiftable seal assembly housed in a recess of a channel member of an operable wall panel. A latch means is mounted in the wall panel and releaseably holds the spring-loaded seal assembly in its retracted, inoperative position. A seal actuator means is operatively coupled to the shiftable seal assembly and when operated, shifts the seal assembly inwardly of the channel member to release the latch means and thereafter the spring-loaded seal assembly automatically shifts outwardly of the channel to its extended, operative sealed position.

In a preferred form, the spring loaded, shiftable seal assembly is coupled to a dual diameter pulley in which a seal actuator means is operatively coupled to the circumference of one pulley and the shiftable seal assembly is operatively coupled to the other circumference of the other pulley and upon rotation of the pulley by the seal actuator means, the spring-loaded seal assembly is shifted inwardly of the channel member to release the latch means so that the seal assembly automatically shifts to its extended, self-leveling, operative position.

These and other objects of the invention will be more readily apparent from the following detailed description of a preferred embodiment according to the invention when taken in conjunction with the following drawings.

DETAILED DESCRIPTION OF THE PREFERRED EMBODIMENT

In the preferred embodiment shown in FIGS. 1-6 of the drawings, an operable drop seal assembly 20 of a wall panel 10 is illustrated. It should be understood that the drop seal assembly illustrated can be modified for use as either a top or side seal assembly without departing from the present invention.

Figure 1:
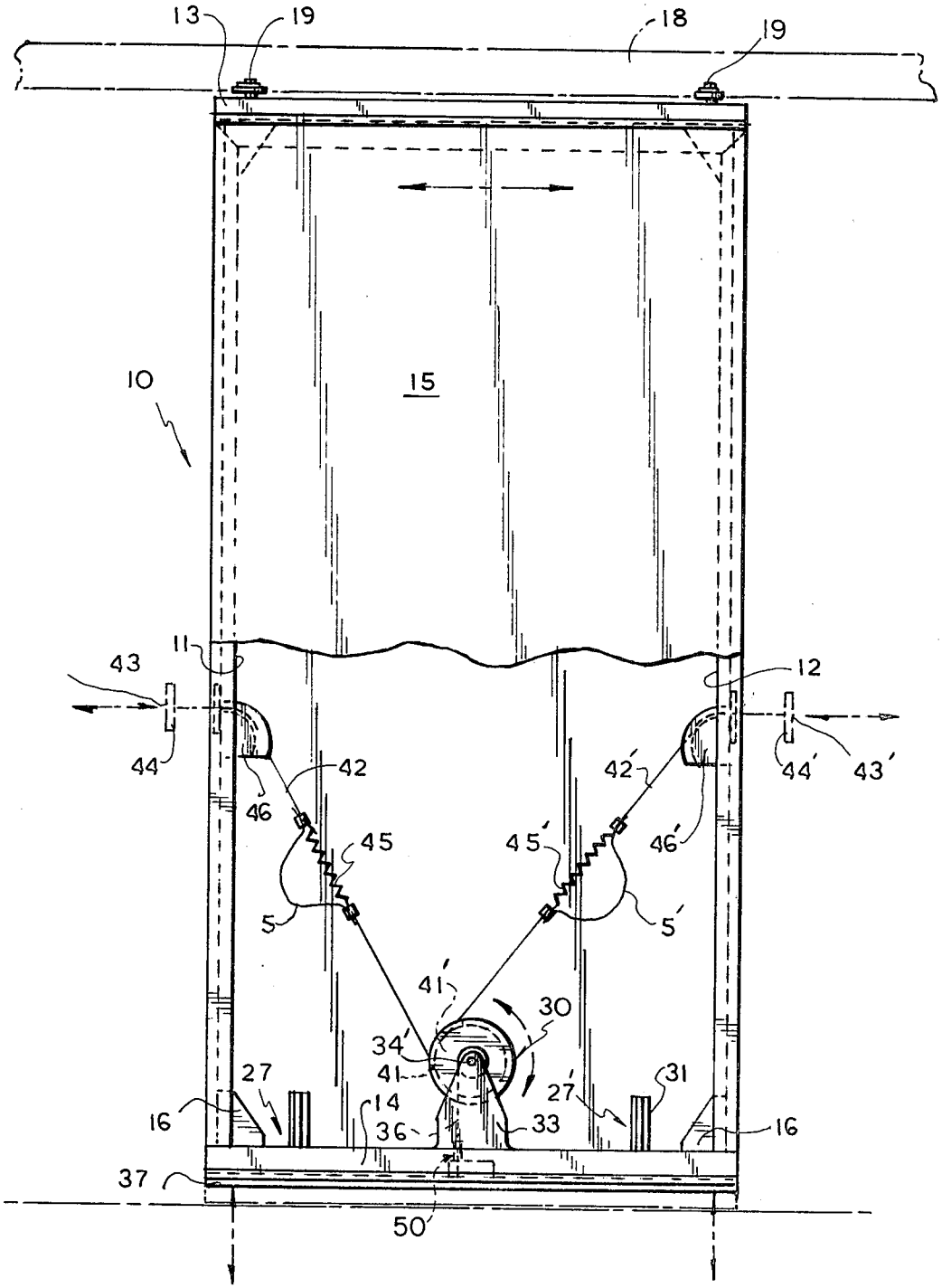
FIG. 1 is an elevational view partly in section of an operable wall panel illustrating the shiftable seal assembly of the present invention.
Figure 2:
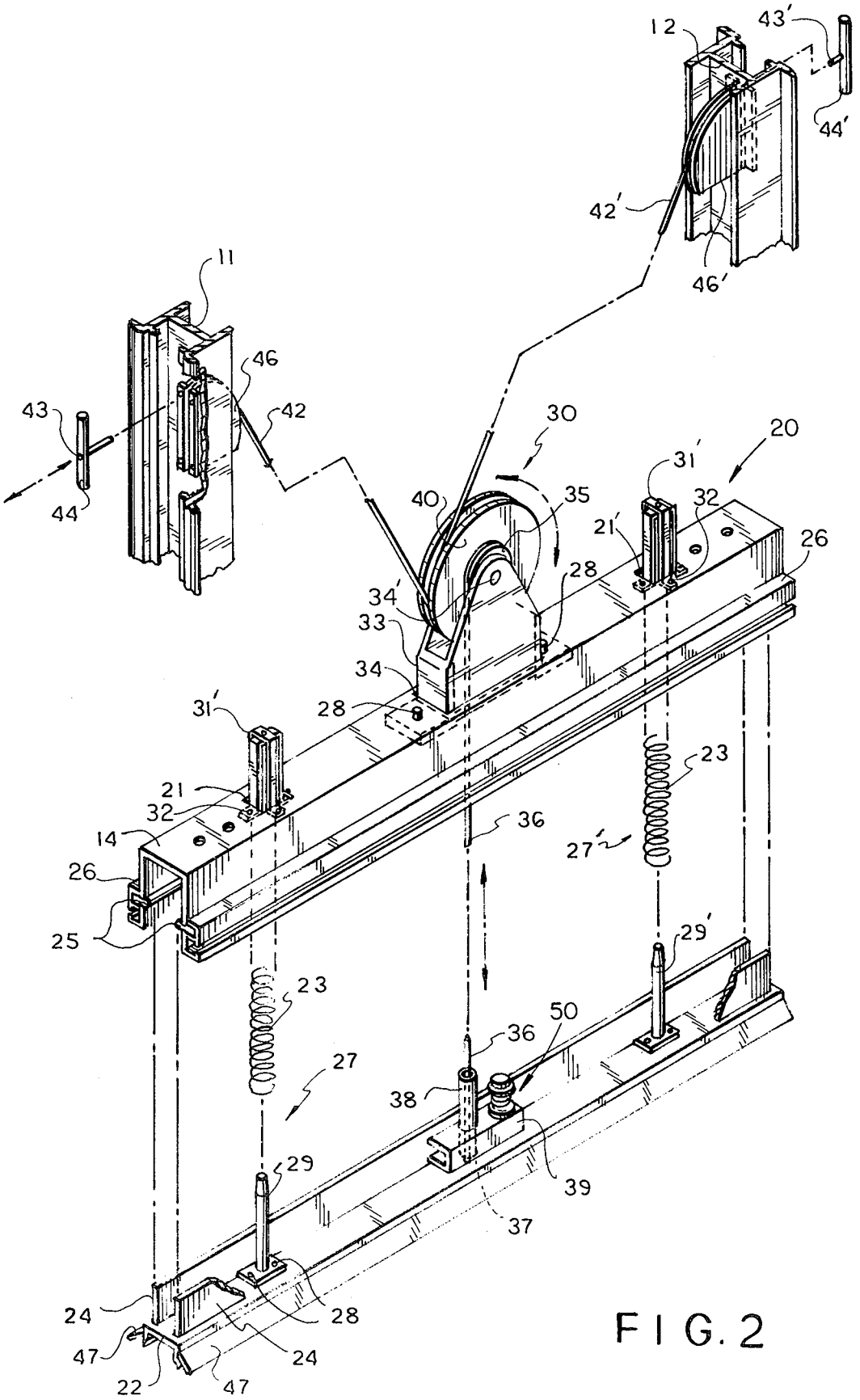
FIG. 2 is an exploded isometric view of the seal assembly of FIG. 1.
Figure 3:
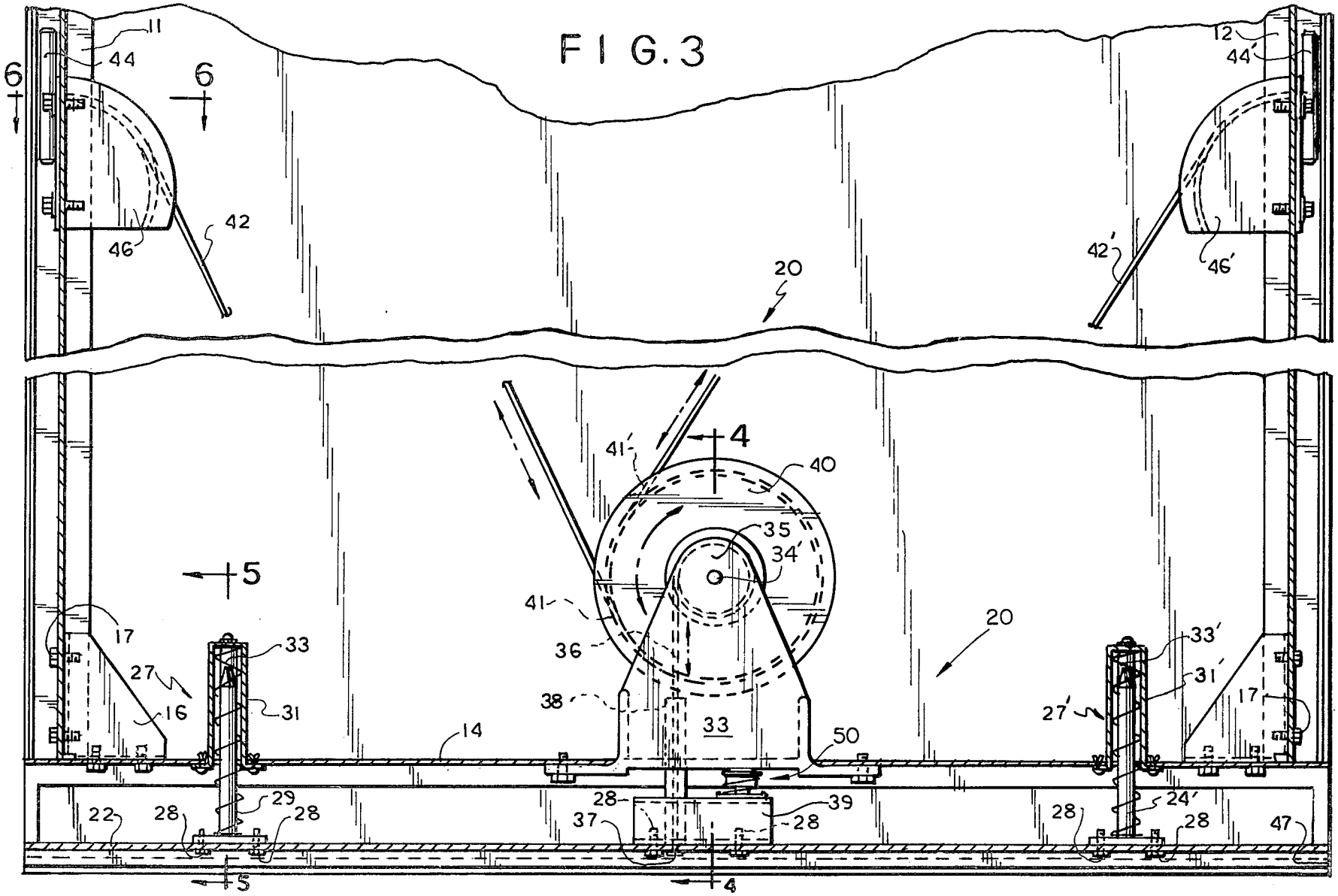
FIG. 3 is an enlarged elevational view, partly in section, and partly broken away, of the seal assembly of FIG. 1.
Figure 4:
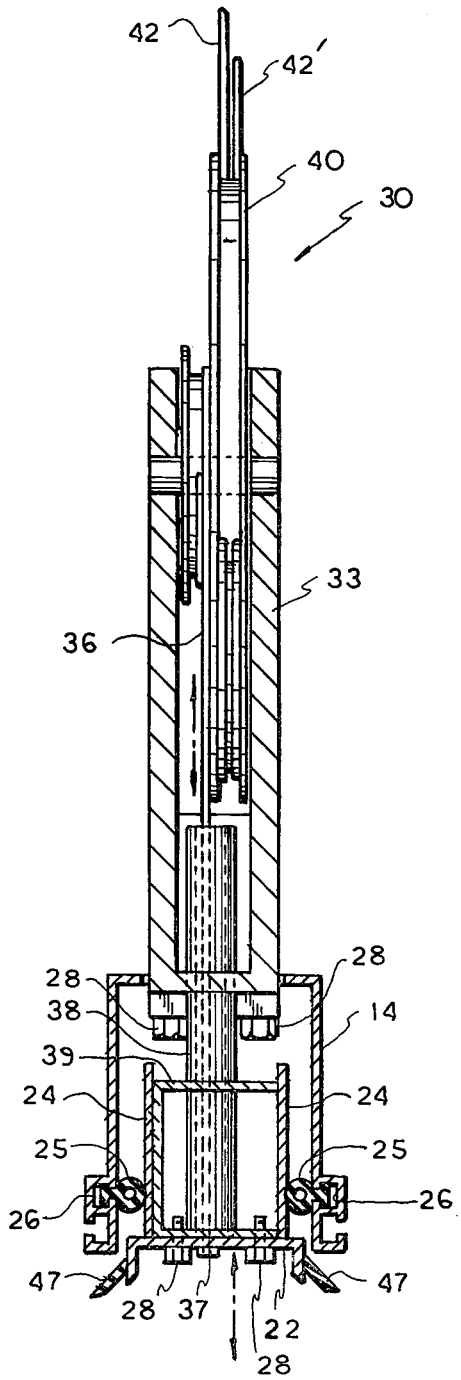
FIG. 4 is an elevational view, in section, of the dual diameter pulley and latch means of the seal assembly taken along the line 4—4 of FIG. 3.

Referring particularly to FIGS. 1-3, operable wall panel 10 includes a frame having a pair of vertical, parallel channels 11, 12 and horizontal channels 13, 14 which form a rectangle when joined together and on which a pair of opposed sheets are mounted that form the finished surfaces or skins 15 of the panel 10. Brackets 16 are mounted in each corner of the rectangular frame as by use of bolts 17 shown most clearly in FIG. 3. A pair of trolleys 19 are mounted on horizontal channel 13 which travels along a rail or track 18 shown in broken line in FIG. 1.

Figure 5:
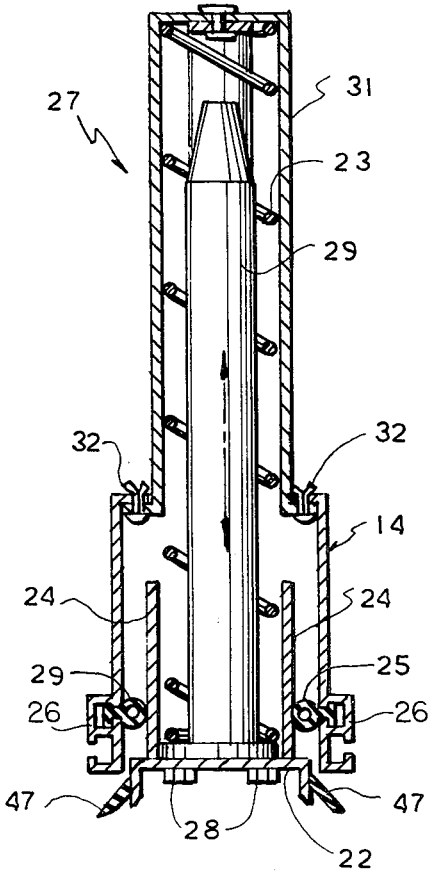
FIG. 5 is an elevational view, in section, of the spring assembly for the seal assembly taken along line 5—5 of FIG. 3.
Figure 6:
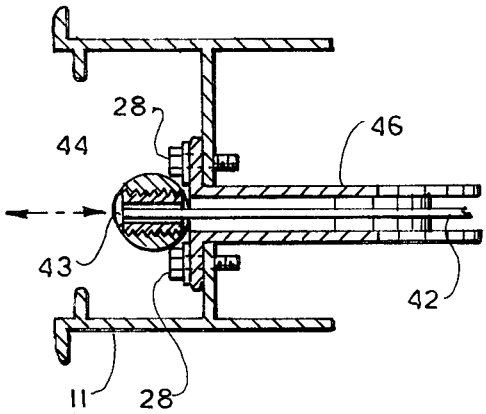
FIG. 6 is a sectional view of the actuator means taken along line 6—6 of FIG. 3.

The component parts forming drop seal assembly 20 are best illustrated in FIG. 2 and shown in full assembly in FIG. 3. Drop seal assembly 20 includes shiftable member 22 operably coupled to dual diameter pulley 30 which is fixedly mounted on horizontal channel 14. Shiftable member 22 is in the form of a channel and has flexible, resilient lips 47 mounted on the walls of the channnel to provide sealed contact with the floor. It is apparent from FIG. 3 that drop seal assembly 20 will automatically align itself with the floor, ceiling or side wall by spring loaded assemblies 27, 27' to form a positive self-leveling seal. Shiftable member 22 includes a pair of parallel, spaced guide flanges 24 which nest within the slot of channel 14 best illustrated in FIGS. 4 and 5. Guide flanges 24 when nested in channel 14 rides or slides against longitudinally extending resilient bumpers 25 which are slidably received in mounting slots 26 formed in channel 14. A pair of spring assemblies 27, 27' are positioned between guide flange 24, and are mounted on shiftable member 22 adjacent each end thereof by nut and bolt assemblies 28. Each spring assembly 27, 27' include a vertical rod 29, 29' over which spring 23, 23' is telescopically received. A pair of openings 21, 21' is provided in channel 14 through which a spring housing 21, 21' is mounted preferably by pop rivets 32. As depicted in FIG. 5, spring assemblies 27, 27' are in a compressed position so that shiftable member 22 is in its retracted or inoperative position.

Dual diameter pulley 30 includes a housing 33 which fits into an opening 34 in channel 14 and is mounted thereto by nut and bolt assemblies 28. Housing 33 is in the form of a yoke in which an axle 34' mounts dual diameter pulley 30 for rotation thereon. Dual diameter pulley 30 comprises a first pulley 35 on which a first cable 36 is fixed at one end thereof. The other end 37 of cable 36 is housed in guide tube 38 and anchored to U-shaped member 39 which is mounted to shiftable member 22 as by nuts and bolts 28, most clearly shown in FIG. 3. One end 41, 41' of a pair of cables 42, 42' is mounted on a second pulley 40 which is of greater diameter than first pulley 35 of dual diameter pulley 30 as illustrated in FIGS. 1–3. The other ends 43, 43' of cables 42, 42' pass through an opening in vertical frame member 11, 12 on which handles 44, 44' are mounted thereon for actuating drop seal assembly 20. Cable guide members 46, 46' are mounted on vertical frame members 11, 12 over which cables 42, 42' are guided. A pair of cable accumulator springs 45, 45' are mounted between the ends of cables 42, 42' to provide extra cable for the rotation of pulley 40 as illustrated in FIG. 1. A section S, S' of cables 42, 42' is connected to each end of accumulator springs 45, 45' so that when either handle 43 or 43' is pulled away from vertical channel 11 or 12, springs 45 or 45' will be shifted to its extended position while the other accumulator spring 45' is relaxed. Simultaneously both pulleys 35, 40 rotate to elevate shiftable member 22 slightly which causes latch means 50 to unlatch whereby shiftable seal assembly will be urged outwardly from horizontal channel 14 to its sealed, self-leveling and operative position, shown in broken line in FIG. 1. Latch means 50 is a cam operated, spring biased, latch and is described in U.S. Pat. No. 3,862,773 which is commercially available. When shiftable seal assembly is to be shifted from its sealed operative position to its inoperative or retracted position, handle 44 or 44' is pulled away from vertical rail 11 or 12, after spring 45 or 45' is extended, section S or S' becomes taut and rotates dual diameter pulley 30. First and second pulleys 35, 40 will rotate to raise drop seal assembly 20 vertically in the direction of the arrow in FIGS. 1–3. Simultaneously, the slack in cables 42, 42' is taken up by second pulley 40 until latch means 50 is actuated to automatically lock drop seal assembly 20 in its retracted, inoperative position.

I claim:

1. A shiftable, self-leveling seal assembly arranged and constructed to be housed within a recess of a wall panel, said assembly comprising:

a shiftable member housed within said recess of said wall panel, spring means mounted on said shiftable member for urging said shiftable member out of said recess;

latch means for holding said shiftable member within said recess in a latched, inoperative position; and a seal actuator means operatively coupled to said shiftable member so that when said shiftable member is moved inwardly of said recess, said shiftable member is automatically urged out of said recess to its extended, operative and self-leveling sealed position.

2. The shiftable self-leveling seal assembly of claim 1 wherein a pulley assembly is mounted in said wall panel and includes a first diameter pulley and a second diameter pulley which are coaxially mounted for rotation, one of said pulleys is operatively coupled to said shiftable member and the other of said pulleys is operatively coupled to said actuator means.

3. A shiftable, self-leveling seal assembly arranged and constructed to be housed within a recess of a wall panel, said assembly comprising:

a shiftable member housed within said recess of said wall panel, spring means mounted on said shiftable member for urging said shiftable member out of said recess;

latch means for holding said shiftable member within said recess in a latched, inoperative position;

a seal actuator means operatively coupled to said shiftable member; and a pulley assembly mounted in said wall panel and having a first diameter pulley and a second diameter pulley which are coaxially mounted for rotation, one of said pulleys is operatively coupled to said shiftable member and the other of said pulleys is operatively coupled to said actuator means.

4. The shiftable self-leveling seal assembly of claim 3 wherein said pulley assembly is a dual diameter pulley of unitary construction.

5. The shiftable self-leveling seal assembly of claim 3 wherein said seal actuator means is a cable, one end of which is operatively coupled to one of said pulleys and the other end is coupled to a handle housed within the recess of said wall panel.

6. The shiftable self-leveling seal assembly of claim 3 wherein said actuator assembly includes a pair of cables one end of each cable being operatively coupled to one of said pulleys and the other ends of said cables terminate on opposite side of said wall panel, each cable end having handle means recessed within said wall panel.

7. The shiftable self-leveling seal assembly of claim 3 wherein said actuator means includes an accumulator mounted on said cable to provide cable to compensate for the rotation of one of said pulleys when said pulley is rotated.

8. The shiftable self-leveling seal assembly of claim 3 wherein said pulley assembly is a dual diameter pulley, one of said pulleys having a diameter greater than the diameter of the other and wherein said actuator means is coupled to the pulley of greater diameter and the shiftable member is coupled to the pulley of lesser diameter.

* * * * *